US009797147B2

(12) United States Patent
Turner

(10) Patent No.: US 9,797,147 B2
(45) Date of Patent: Oct. 24, 2017

(54) WATER PROOF CONSTRUCTION UNIT

(71) Applicant: Void Form Products, Inc., Inglewood, CO (US)

(72) Inventor: Michael L. Turner, Fort Worth, TX (US)

( * ) Notice: Subject to any disclaimer, the term of this patent is extended or adjusted under 35 U.S.C. 154(b) by 0 days.

(21) Appl. No.: 15/204,858

(22) Filed: Jul. 7, 2016

(65) Prior Publication Data

US 2017/0009468 A1 Jan. 12, 2017

Related U.S. Application Data

(60) Provisional application No. 62/190,127, filed on Jul. 8, 2015.

(51) Int. Cl.

| | |
|---|---|
| ***E04B 1/00*** | (2006.01) |
| ***E04G 9/08*** | (2006.01) |
| ***E04B 5/36*** | (2006.01) |
| ***E02D 27/01*** | (2006.01) |
| *E03F 5/04* | (2006.01) |
| *E04G 9/02* | (2006.01) |
| *E04G 9/10* | (2006.01) |
| *E04B 5/32* | (2006.01) |
| *E04G 15/06* | (2006.01) |

(52) U.S. Cl.

CPC ..... *E04G 9/086* (2013.01); *E02D 27/01* (2013.01); *E04B 5/36* (2013.01); *E03F 5/0407* (2013.01); *E03F 5/0408* (2013.01); *E03F 5/0409* (2013.01); *E04B 5/326* (2013.01); *E04G 9/021* (2013.01); *E04G 9/08* (2013.01); *E04G 9/10* (2013.01); *E04G 15/061* (2013.01)

(58) Field of Classification Search

CPC . E04B 5/36; E04B 5/326; E04G 9/086; E04G 9/10; E04G 9/021; E04G 9/08; E03F 5/0409; E03F 5/0407; E03F 5/0408

USPC .... 297/169.1, 169.5, 169.14, 310, 408, 409, 297/410, 302.1, 302.7, 793.1, 783.11, 297/463, 464; 52/169.1, 169.5, 169.14, 52/310, 408, 409, 410, 302.1, 302.7, 52/793.1, 783.11, 463, 464

See application file for complete search history.

(56) References Cited

U.S. PATENT DOCUMENTS 4,078,351 A * 3/1978 Simpson ..... E04B 7/105 52/462

4,577,450 A * 3/1986 Large ..... B64C 1/18 411/369

(Continued)

FOREIGN PATENT DOCUMENTS

GB 2235235 * 8/1989 ..... E04B 1/12

*Primary Examiner* — Chi Q Nguyen

(74) *Attorney, Agent, or Firm* — Law Office of Jeff Williams; J. Oliver Williams

(57) ABSTRACT

The present application includes a void form unit for creating a void space between concrete structures and expansive soil. The unit includes a cellular structure surrounded by a paper based shell. The cellular structure is impervious to moisture. Together the cellular structure and the shell make a singular rigid member. The rigid member is configured to temporarily support concrete and gradually increase in flexure so as to flex with the movement of the expansive soil. The shell is configured to weaken over time from the regulated absorption of moisture. The flexure of the cellular structure configured to increase with the deterioration of the shell.

10 Claims, 2 Drawing Sheets

(56) References Cited

U.S. PATENT DOCUMENTS

| | | | | |
|---|---|---|---|---|
| 4,910,928 | A * | 3/1990 | Cellar, Jr. | E04H 1/1222 52/282.1 |
| 5,107,654 | A * | 4/1992 | Leonardis | E04C 5/20 52/677 |
| 6,253,530 | B1 * | 7/2001 | Price | E04B 1/12 156/71 |
| 2004/0074205 | A1 * | 4/2004 | Stache | E04C 2/36 52/783.11 |
| 2008/0010943 | A1 * | 1/2008 | Marschke | E01D 19/125 52/793.1 |
| 2013/0145714 | A1 * | 6/2013 | Walker | E04C 2/34 52/580 |
| 2015/0275497 | A1 * | 10/2015 | Nyce | E03F 5/0409 52/302.1 |

* cited by examiner

WATER PROOF CONSTRUCTION UNIT

BACKGROUND

1. Field of the Invention

The present application relates generally to construction products, and in particular to an apparatus for a water proof component void form to create space between concrete structures and expansive soil.

2. Description of Related Art

A plurality of structures are built on and in expansive soils. Once poured and hardened, a concrete structure in contact with the expansive soil may develop cracks and ultimately fail if the soil heaves or moves. Therefore, building codes and engineering specifications often require the formation of a gap, often referred to as a void space, between the concrete structure and the expansive soil to act as a buffer from soil movement.

Typically, a method of generating a void space has been to use a 100% paper based corrugated paper product that is laid along the ground prior to pouring the concrete. The paper product is used as part of the form for the concrete. The paper product includes some measures to resist water absorption due to contact with wet concrete and the soil, however, these measures are only temporary. In time, the paper product deteriorates from the absorption of water and loses its strength after the concrete has set. This creates a space into which soil can expand without causing damage to the concrete.

A problem with using paper based products is that the product is only water resistant and not water-proof. When soil is saturated, conventional paper products cannot be used. Paper void forms absorb moisture and standing water, and deteriorate too quickly. When deteriorating, the strength of the paper material is greatly reduced. Some ways to compensate for these deficiencies have been for manufacturers to overly design their forms with excess paper material. This is done to maximize the strength of the form structure in the event of moisture exposure. A problem with this is obviously the cost and waste of excess materials. Ultimately, paper forms are too susceptible to moisture levels and too difficult to predict their strength at end use when manufacturing the form.

Void forms are designed to specific strength ratings. A form should be sufficient to hold the concrete pour and permit soil fluctuations without affecting the concrete. Over strengthened void forms from the use of excess paper products tend to be too strong and can transfer soil movements to the concrete, thereby causing foundation issues. On the other hand, if exposed to too much moisture, void forms become prematurely weak in order to support the foundation during concrete placement. A better product is needed to allow more accurate and predictable results that minimize the effect of moisture and the amount of material used to produce a form.

In operation, time is required to set a series of paper void forms in place to pour the concrete structure. The surface soil must be prepared, the paper void forms must be placed, ¼" protection board placed upon the entire carton form surface, and the rebar must be laid out prior to pouring concrete. This process could take anywhere from a number of hours to a number of days depending on the size of the project, project design and jobsite conditions. If rain or saturation of the soil occurs at any point prior to pouring concrete, the foundation may be compromised. The forms would need to be removed and discarded, and the work would have to be redone.

Given the present use of paper void forms, in order to minimize the effects of moisture, a water proof covering can be used. However, such coverings tend to limit or prevent proper ventilation within the paper void form. By not having sufficient air movement, a concern is that humidity can become trapped below the covering. If the paper product becomes saturated, the structural integrity may be compromised. Such concerns and procedures to ensure proper storage and application can lead to loss of product, increased expenses, and lost time.

Although great strides have been made with respect to forming the void space between concrete structures and expansive soil, it is obvious that considerable shortcomings remain with the conventional paper based void forms. A new type of corrugated construction product is needed.

DESCRIPTION OF THE DRAWINGS

The novel features believed characteristic of the application are set forth in the description. However, the application itself, as well as a preferred mode of use, and further objectives and advantages thereof, will best be understood by reference to the following detailed description when read in conjunction with the accompanying drawings.

Figure 1:
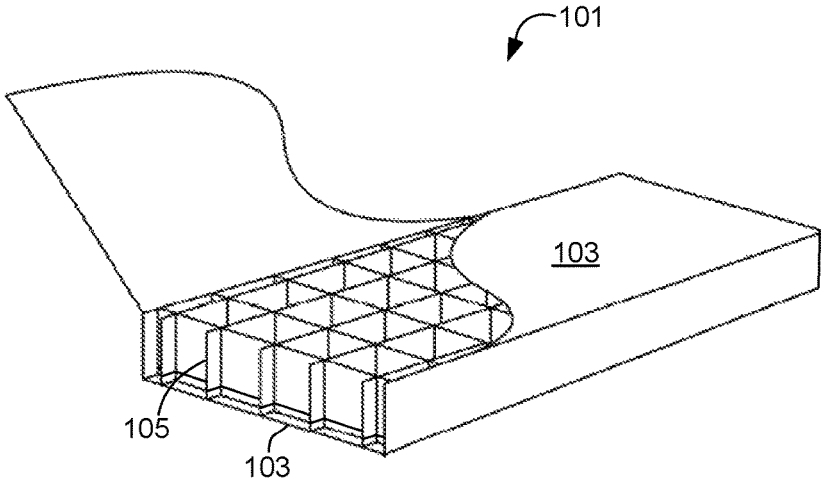
FIGS. 1 and 2 are a perspective view and an end view of a water proof construction unit according to a preferred embodiment of the present application.

While the application is susceptible to various modifications and alternative forms, specific embodiments thereof have been shown by way of example in the drawings and are herein described in detail. It should be understood, however, that the description herein of specific embodiments is not intended to limit the application to the particular forms disclosed, but on the contrary, the intention is to cover all modifications, equivalents, and alternatives falling within the spirit and scope of the application as described herein.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The apparatus and method in accordance with the present application overcomes one or more of the above-discussed problems commonly associated with conventional corrugated paper product forms. Specifically, the apparatus of the present application is configured to provide a water proof structure suitable for application in moist or saturated soils. It is a further object of the present application to allow for movement of the expansive soil under the concrete structure in order to avoid damage while providing sufficient support to a foundation above the form. The apparatus of the present application is configured to provide accurate and predictable performance characteristics irrespective of moisture. Furthermore, the strength of the form is predictable so as to minimize the amount of material used to produce a form. These and other unique features of the device are discussed below and illustrated in the accompanying drawings.

The apparatus will be understood, both as to its structure and operation, from the accompanying drawings, taken in conjunction with the accompanying description. It should be understood that various components, parts, and features of the device may be combined together and/or interchanged with one another, all of which are within the scope of the present application, even though not all variations and particular embodiments are shown in the drawings. It should also be understood that the mixing and matching of features, elements, and/or functions is expressly contemplated herein so that one of ordinary skill in the art would appreciate from this disclosure that the features, elements, and/or functions of one embodiment may be incorporated into another embodiment as appropriate, unless otherwise described.

The apparatus of the present application includes a unit having an outer host shell and an interior cellular structure. The cellular structure is configured to be impervious. The host shell is configured to wrap around the upper and side portions of the cellular structure and couple to one or more lower portions of the cellular structure. The wrapping nature of the shell helps to increase the structural rigidity as a single unit. The host shell helps to maintain the structural configuration of the cellular structure. A method of using the unit includes forming the unit to a desired shape and securing the cellular structure to the outer shell as necessary. Other steps may be necessary.

Referring now to the figures wherein like reference characters identify corresponding or similar elements in form and function. The following Figures describe corrugated construction unit 101 and its associated features to provide for an impervious substrate configured to create a void space between concrete and expansive soil. Unit 101 is configured to act as an initial support for newly poured concrete and permit movement of the soil without compromising the structural integrity of the concrete. This results in the need to have a particular balance between its level of rigidity and level of flexibility.

Figure 2:
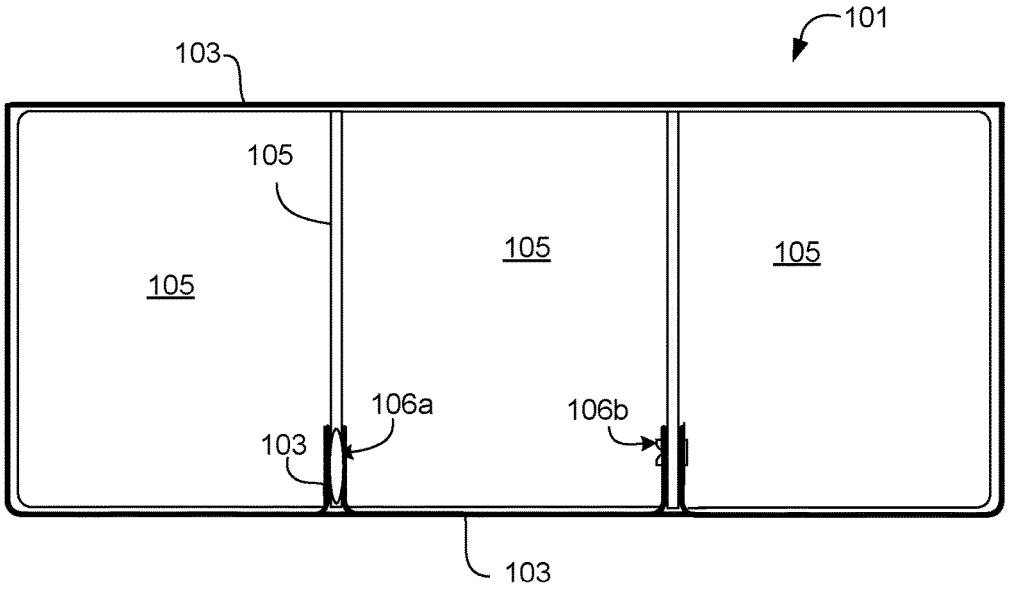

Referring to FIGS. 1 and 2 in the drawings, a water proof interior construction unit 101 is illustrated. Unit 101 is a water proof component void form used for creating a void space between concrete structures and expansive soil. Unit 101 includes an outer host shell 103 and an impervious internal cellular structure 105. The cellular structure is formed from an impervious material so as to avoid the absorption of moisture. Shell 103 is configured to selectively wrap around and couple to cellular structure 105 so as to form a singular rigid member. Shell 103 is configured to maintain and ensure the configuration of structure 105. Structure 105 is configured to bear the loads exerted from the concrete and from the soil. It is highly recommended that a protection board (i.e. hardboard) be placed on top of all structures 105 in order to ensure proper functions. For example, a protection board of ¼" thickness would suffice in most applications.

The structural strength of host shell 103 is configured to weaken over time by the gradual absorption of moisture. Shell 103 may be made from any number of materials. Shell 103 is not necessarily required to be impervious to moisture. In fact, certain advantages may be seen from the progressive deterioration of shell 103. An ideal example of a suitable material for shell 103 is a paper based product. Regardless of the material selected, the deterioration of shell 103 is not required for unit 101 to adequately operate as intended.

Unit 101 temporarily supports the placement of structural concrete walls, grade beams, and slabs over expansive soil sufficient to allow for the proper curing of the concrete. In time, shell 103 may be configured to deteriorate from moisture and other decomposition factors. Efforts may be taken to regulate such deterioration, such as the use of a moisture resistant exterior surface applied to shell 103. It is understood that such moisture resistant exterior surface is optionally included. During decomposition of shell 103, the strength of unit 101 is maintained through structure 105. Structure 105 does not rely on added tensile strength provided from shell 103.

Cellular structure 105 or the individual components are configured to flex with the movement of expansive soil. Therefore, unit 101 is configured to provide great initial strength while also providing long term flexibility within the void space despite the use of impervious materials.

The use of an impervious cellular structure 105 allows for unit 101 to withstand saturated environments during preparation of the pouring of concrete. The impervious nature of cellular structure 105 provides structural integrity as shell 103 absorbs moisture. This is not seen in traditional forms and acts to save time and money as unit 101 is able to be used in more saturated conditions without reworking. Additionally, the impervious nature of cellular structure 105 allows for unit 101 to be tailored to specific design performance characteristics, such as strength. No excess or wasted material is needed as moisture is no longer an issue. The strength of cellular structure 105 may be varied by adjusting cell size, thickness, and even type of material. A plastic material is one example of a suitable material for cellular structure 105.

It is understood that shell 103 is in no way limited to any particular type of paper material. Shell 103 may take a form having varied thicknesses, corrugation patterns, densities, and so forth. As stated above, shell 103 is configured to surround and selectively bond to cellular structure 105. In such a way, shell 103 is configured to create a seamless upper surface. Shell 103 is configured to wrap around the sides and underneath cellular structure 105. The two elements are secured together through the use of one or more fastening members 106. Such members may be staples **106*b* and/or an adhesive 106*a*. Unit 101 may use fasteners 106 along any of the edges of cellular structure 105 in order to secure it to shell 103. Shell 103 is designed to assist in keeping the shape of cellular structure 105. Use of cellular structure 105 with shell 103 permits unit 101** to function in saturated soils without fear of collapse and decreased structural integrity.

There are many advantages to using unit 101. Unit 101 is lightweight and extremely easy to install. Individual units 101 may be oriented in a plurality of different ways. Each unit may be customarily sized to fit a particular need. Additionally, unit 101 may be stacked on top of other units. Each unit may be configured to have a particular strength rating different from that of another unit being used on the same site. This decreases the expense and time to install. Unit 101 may further include additional surface treatments, such as wax layers, sprayed on moisture guards, and so forth to further assist in regulating moisture absorption.

Figure 3:
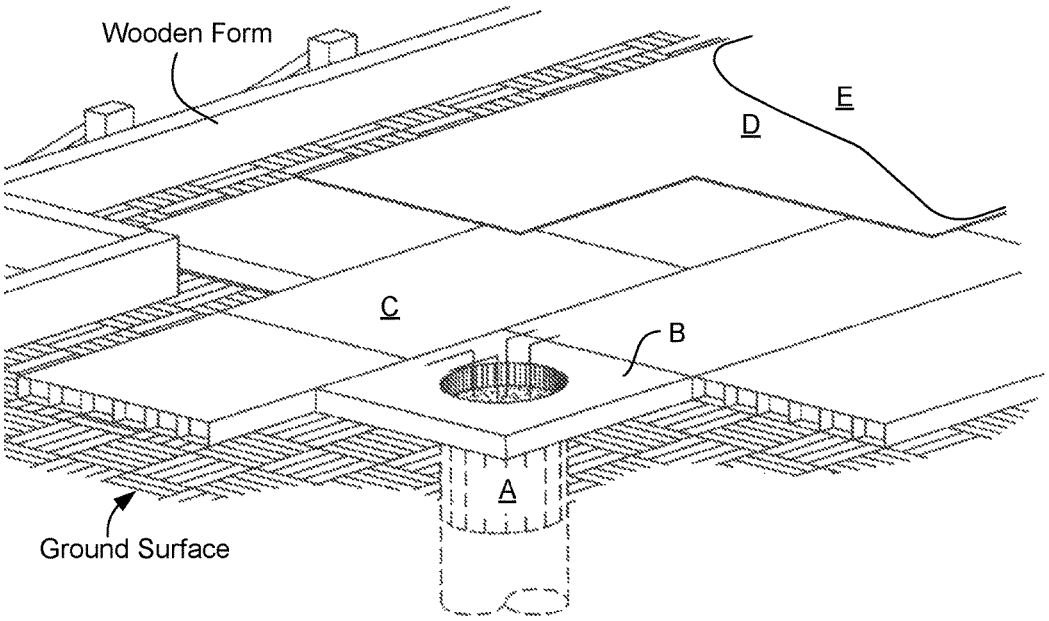
FIG. 3 is a perspective view of a job site showing the water proof construction unit of FIG. 1 in various different embodiments.
Figure 4:
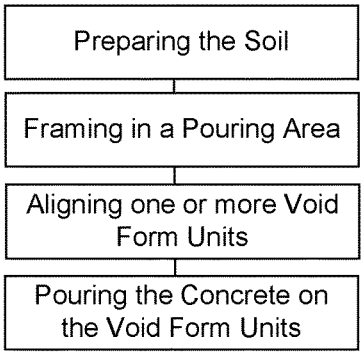
FIG. 4 is a chart of the method of using the water proof construction unit of FIG. 1.

Referring now also to FIG. 3 in the drawings, various uses and types of units 101 are illustrated. Unit 101 is configured to be designed and formed into multiple sizes and shapes. This allows it to be used for a plurality of different uses. For example, unit 101 is shown in FIGS. 1 and 2 for use with slab work. The concept of unit 101 may equally be applied to other areas, such as walls, piers, beams, and trenches. As seen in FIG. 3, unit 101 is shown at C at a job site for use with slabs of concrete. Wooden forms are supported around the perimeter. A drilled pier top form is shown at A. In this use, unit 101 is cylindrically formed. Unit 101 is also shown for making a pier at B. In B, unit 101 has a central channel to permit the passage of concrete.

The method of using unit 101 contains a number of steps. Some of the steps are as follows. The ground surface is prepared and measured to ensure that units 101 are sized appropriately. The ground should be on an even plane as much as possible. Unit 101 is then assembled according to design needs. Trimming and sizing adjustments may be necessary. Unit 101 (in its associated forms) is installed relative to the surface of the soil. Because of the impervious nature of cellular structure 105 and the coupling of shell 103 to cellular structure 105, the precise moisture content of the soil is of little concern. The use of ¼" Hardboard (i.e. "D" in FIG. 3) is mandatory during initial setup to avoid any damage to unit 101. This eliminates the concern of punctures from point loads and helps to cover gaps between units. A protective sheet (i.e. "E" in FIG. 3) may then be optionally placed across unit 101 to provide additional protection from moisture. Additionally, an optional seam pad may be used to prevent the passage of concrete between neighboring units 101. The concrete may then be poured as necessary.

Unit 101 includes a number of advantages, such as at least the following: (1) ability to be impervious to moisture; (2) coupling the outer shell to the internal cellular structure to give rigidity; (3) flexibility of the cellular structure after deterioration of the outer shell to flex as the soil moves; and (4) decreased time and costs associated with preparation work prior to pouring the concrete.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A water proof component void form for creating a void space between concrete structures and expansive soil, comprising:

a cellular structure formed from an impervious material so as to avoid an absorption of moisture; and a paper based shell configured to selectively wrap around and couple to the cellular structure so as to form a singular rigid member, the paper based shell passing internally within a portion of the cellular structure;

wherein a structural strength of the singular rigid member is configured to weaken over time by a gradual absorption of moisture in the paper based shell, a weakening occurring from contact with the setting concrete.

2. The void form of claim 1, wherein the cellular structure is configured to flex due to movement of the expansive soil when pressed against the concrete.

3. The void form of claim 1, wherein the cellular structure is formed into a selected honeycomb pattern, such that the honeycomb pattern is aligned vertically within the shell.

4. The void form of claim 1, wherein the shell is coupled to the cellular structure via a fastening member.

5. The void form of claim 4, wherein the fastening member is at least one of a staple and an adhesive.

6. The void form of claim 1, wherein the shell includes a moisture resistant exterior surface configured to delay weakening prior to pouring of the concrete.

7. The void form of claim 1, wherein a flexure rate of the cellular structure varies in relation to the level of moisture absorbed by the shell.

8. The void form of claim 1, wherein the singular rigid member is configured to support a weight of a worker.

9. The void form of claim 1, further comprising:

a seam pad configured to span a gap between adjoining rigid members to prevent passage of concrete between such rigid members.

10. The void form of claim 1, wherein a shape of the singular rigid member is at least one of rectangular, trapezoidal, and circular.

* * * * *